US009427758B2

(12) United States Patent
Kosaka

(10) Patent No.: US 9,427,758 B2
(45) Date of Patent: Aug. 30, 2016

(54) SPRAY GUN WITH IMPROVED TRIGGER RETAINING SHAFT

(71) Applicant: ANEST IWATA Corporation, Kanagawa (JP)

(72) Inventor: Shozo Kosaka, Kanagawa (JP)

(73) Assignee: ANEST IWATA CORPORATION, Kanagawa (JP)

( * ) Notice: Subject to any disclaimer, the term of this patent is extended or adjusted under 35 U.S.C. 154(b) by 141 days.

(21) Appl. No.: 14/246,482

(22) Filed: Apr. 7, 2014

(65) Prior Publication Data

US 2014/0299678 A1 Oct. 9, 2014

(30) Foreign Application Priority Data

Apr. 9, 2013 (JP) ..... 2013-081664

(51) Int. Cl.
*B05B 7/02* (2006.01)
*B05B 9/01* (2006.01)
*B05B 12/00* (2006.01)

(52) U.S. Cl.
CPC . *B05B 9/01* (2013.01); *B05B 7/02* (2013.01); *B05B 12/002* (2013.01)

(58) Field of Classification Search
CPC ..... B05B 9/01; B05B 15/06; B05B 7/02; B05B 12/002
USPC ..... 239/600
See application file for complete search history.

(56) References Cited

U.S. PATENT DOCUMENTS 5,160,092 A * 11/1992 Rose ..... B05B 15/00 239/288
6,460,787 B1 * 10/2002 Hartle ..... B05B 1/3046 239/691
7,328,860 B1 * 2/2008 Chen ..... B05B 1/3026 137/625.31
7,694,893 B2 * 4/2010 Zittel ..... B01F 5/0256 239/117
2005/0076941 A1 * 4/2005 Larson ..... A61H 3/02 135/68
2006/0107982 A1 * 5/2006 Tsai ..... A61H 3/02 135/72

FOREIGN PATENT DOCUMENTS

JP 9-253538 9/1997
WO 96/00130 1/1996
WO 2011/062752 5/2011

OTHER PUBLICATIONS

Extended European Search Report issued Aug. 13, 2014 in corresponding European patent application No. 14 16 3835.

* cited by examiner

*Primary Examiner* — Ryan Reis
(74) *Attorney, Agent, or Firm* — Wenderoth, Lind & Ponack, L.L.P.

(57) ABSTRACT

There is provided a spray gun comprising: a gun main body; and a trigger having a first locking portion and a second locking portion, the first locking portion locked at one end of a shaft portion provided on the gun main body, the second locking portion locked at the other end of the shaft portion, the trigger operable to rotate about the shaft portion, wherein the shaft portion comprises: a first retaining shaft disposed in a mounting hole formed in the gun main body and locked rotatably on the first locking portion of the trigger; and an elastic member disposed in the mounting hole to bias the first retaining shaft in a direction in which the first retaining shaft exits from the mounting hole.

10 Claims, 7 Drawing Sheets

SPRAY GUN WITH IMPROVED TRIGGER RETAINING SHAFT

BACKGROUND OF THE INVENTION

The present invention relates to a spray gun and more particularly to a mounting construction of a trigger of such a spray gun.

For example, as described in Patent Literature 1 below, to spray gun which sprays an atomized mist of paint is configured so that an atomized mist of paint is sprayed from a spray nozzle which is attached to a distal end of a gun main body through a needle valve and that a flow of compressed air is delivered to a distal end of the spray nozzle to collide with paint to be sprayed for mixing therewith.

The spray gun configured in this way can spray paint which is converted into very fine particles.

As this occurs, the spray of paint from the spray nozzle and the delivery of compressed air to the distal end of the spray nozzle can be executed simultaneously by rotating the trigger mounted on the gun body.

The trigger is mounted on the gun body as shown in FIGS. 8A, 8B, 8C. FIG. 8A is a perspective view of a spray gun 1 as seen from one side thereof, FIG. 8B is a perspective view of the spray gun 1 as seen from the other side thereof, and FIG. 8C is an exploded view of the spray gun 1 with a shaft portion which locks a trigger of the spray gun 1 removed therefrom.

As shown in FIGS. 8A, 8B, 8C, a trigger 3 has to first locking portion 3A and a second locking portion 3B. One end of a shaft portion 30 which is disposed so as to extend through a barrel portion 2 of a gun main body is inserted into the first locking portion 3A, and the other end of the shaft portion 30 is inserted into the second locking portion 3B. The shaft portion 30 is made up of a shaft member which has to head portion 30T at an and which is inserted into the first locking portion 3A and a groove 30M at the other end which is inserted into the second locking portion 3B. A snap ring 30F is fitted in the groove 30M.

In this configuration, the trigger 3 is mounted on the spray gun 1 so as to rotate relative to the gun main body about the shaft member as a fulcrum with the first locking portion 3A held by the barrel portion 2 of the gun main body and the head portion T of the shaft member therebetween and the second locking portion 3B held by the barrel portion 2 of the gun main body and the snap ring 30F which is fitted on the retaining, shaft 30F therebetween.

It is noted that FIGS. 8A, 8B, 8C are drawn in comparison with FIGS. 1A, 1B, 1C, respectively, which show an embodiment of the present invention, and configurations of the respective constituent portions of the spray gun 1 will be described when embodiments of the present invention will be described.

PRIOR ART LITERATURE

Patent Literature

Patent Literature 1: Japanese Laid-Open Publication No. H09-253538

SUMMARY OF THE INVENTION

However, the mounting construction of the trigger on the gun main body has the following drawbacks. That is, when the trigger is removed from the gun main body in, for example, carrying out maintenance work on the spray gun 1, a special tool is needed to remove the snap ring from the shaft member, and there is possibility that the snap ring so removed may be lost. Additionally, the same drawbacks have to be encountered when the snap ring is mounted back on the shaft member.

The spray gun 1 also has an additional problem that looseness is generated between the trigger and the gun main body or between the trigger and the retaining shaft or the snap ring as a result of such a production tolerance as a variation in distance over which the first locking portion and the second locking portion of the trigger are spaced apart. With a view to solving the problem of looseness, the locking portions of the trigger are formed so as to be inclined towards each other at one ends thereof so that they temporarily approach each other to reduce the looseness. However, this is insufficient to solve or absorb completely the variation in distance between the locking portions of the trigger which is caused as one of the production tolerances leading to a problem that the looseness recurs is as result of the spray gun being used continuously.

In addition to the problem of looseness, due to a design limitation, it is difficult for a gun main body of a certain width to be used commonly on different types of spray guns. Therefore, different trigger-related parts including a trigger, a retaining shaft and the like have to be prepared for different gun main bodies which are different in width in the range of only several millimeters in order to eliminate the problem of looseness. Thus, an additional problem of cost is caused by the difficulty in making common use of a gun main body of one width on different types of spray guns. Additionally, as to the snap ring, the irregular shape thereof is exposed to the eyes of a user, which deteriorates the appearance of the snap ring. In the conventional example shown in FIG. 8, the snap ring is laterally asymmetric and this makes the design thereof unfavorable.

The present invention has been made in view of these situations, and an object thereof is to provide a spray gun in which a trigger can be reliably mounted on as gun main body while the trigger can be mounted on and removed from the gun main body extremely easily, which can absorb production tolerances of the spray gun main body or the trigger so as to make common use of the trigger-related parts even for gun main bodies which are slightly different in width and which has a superior design.

The present invention can be understood well by knowing the following configurations.

According to one aspect of the present invention, there is provided a spray gun comprising: a gun main body; and a trigger having a first locking portion and a second locking portion, the first locking portion locked at one end of a shaft portion provided on the gun main body, the second locking portion locked at the other end of the shaft portion, the trigger operable to rotate about the shaft portion. The shaft portion comprises: a first retaining shaft disposed in a mounting hole formed in the gun main body and locked rotatably on the first locking portion of the trigger; and an elastic member disposed in the mounting hole to bias the first retaining shaft in a direction in which the first retaining shaft exits from the mounting hole. The mounting hole may be, for example, a through hole which penetrates the gun main body, or a bottomed hole formed in the gun main body.

According to one aspect of the present invention, there is provided a spray gun including a gun main body, and a trigger which has a first locking portion which is locked at one end of a shaft portion disposed to extend through the gun main body and a second locking portion which is locked at the other end of the shaft portion and which trigger is operated to rotate about the shaft portion, wherein the shall portion is incorporated in a through hole which penetrates the gun main body and includes a first retaining shaft which is locked rotatably on the first locking portion of the trigger, a second retaining shaft which is locked rotatably on the second locking portion of the trigger, and an elastic member which is disposed between the first retaining shaft and the second retaining shaft to bias the first retaining shaft and the second retaining shall in directions in which the first retaining shaft and the second retaining shaft move away from each other.

According to one aspect of the present invention, there is provided a spray gun including a gun main body, and a trigger which has a first locking portion which is locked at one end of a shaft portion formed on the gun main body and a second locking portion which is locked at the other end of the shaft portion and which trigger is operated to rotate about the shaft portion. The shaft portion on which at least either of the first locking portion and the second locking portion of the trigger is locked includes a retaining shaft which is disposed in a bottomed hole formed in the gun main body, and an elastic member which is disposed between a bottom portion a the bottomed hole and the retaining shaft to bias the retaining shaft in a direction in which the retaining shaft moves away from the bottom portion.

DETAILED DESCRIPTION OF THE PREFERRED EMBODIMENTS

Figure 1C:
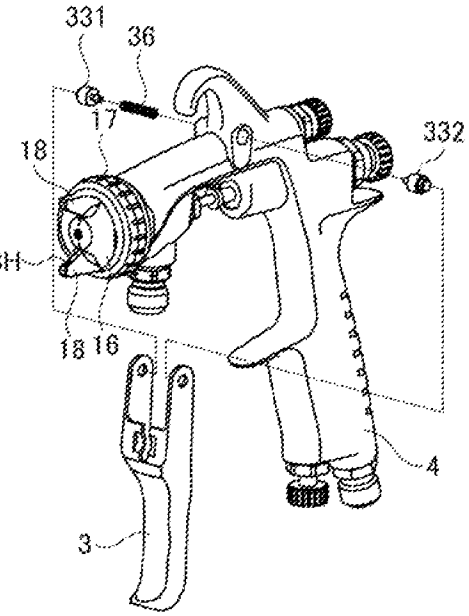
FIGS. 1A, 1B, 1C are a schematic view which shows an external appearance of a spray gun of the present invention.

Hereinafter, embodiments for carrying, out the present invention (hereinafter, referred to as embodiments of the present invention) will be described in detail by reference to the accompanying drawings. In describing all embodiments of the present invention, like reference numerals will be given to like constituent elements.

Embodiment 1

Figure 1B:
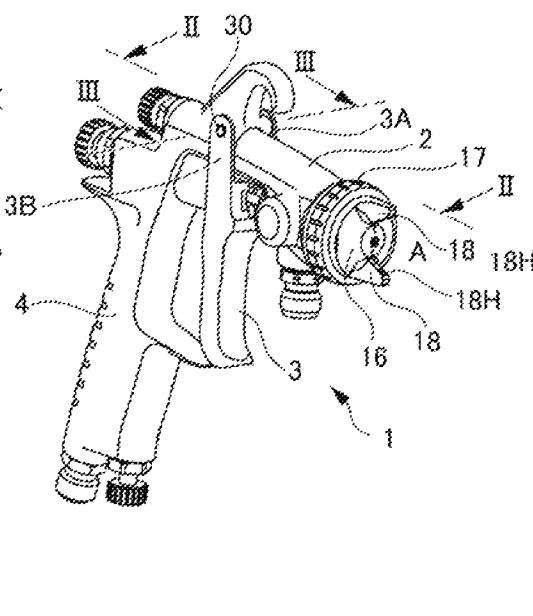
Figure 1A:
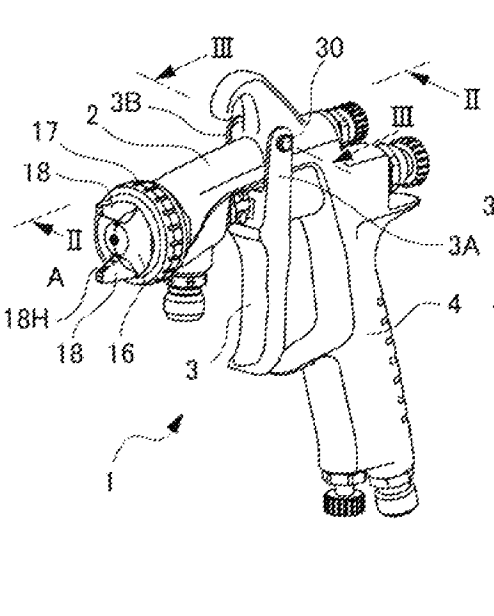

FIGS. 1A, 1B are schematic views which show an external appearance of a spray gun of the present invention. FIG. 1A is a perspective view of a spray gun 1 as seen from one side thereof, and FIG. 1B is a perspective view of the spray gun 1 as seen from the other side thereof.

As shown in FIGS. 1A, 1B, the spray gun 1 includes a barrel portion 2, a trigger portion 3 and a grip portion 4 (in this specification, the barrel portion 2 and the grip portion 4 are referred to together as a gun main body from time to time). The spray gun 1 is configured so that a flow of mist of paint and a flow of air are sprayed from a distal end portion (denoted by reference character A in the figures) of the barrel portion 2 so as to be mixed with each other to thereby be sprayed together by operating the trigger 3. Here, an overall configuration of the spray gun 1 will schematically be described before the description of a mounting construction of the trigger 3 of the spray gun.

Figure 2:
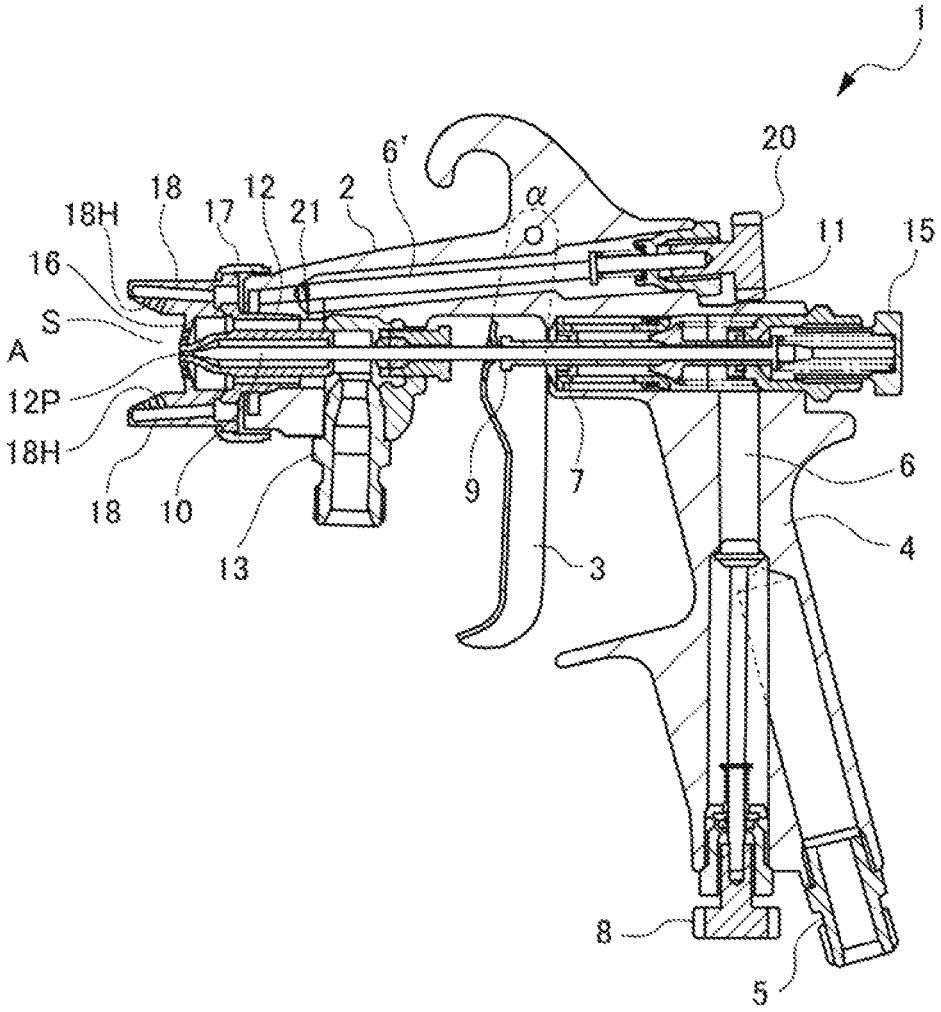
FIG. 2 is a sectional view of the spray gun of the present invention.

FIG. 2 is a sectional view taken along the line II-II in FIGS. 1A, 1B.

In FIG. 2, compressed air is sent from the grip portion 4 of the spray gun 1 into an air valve portion 7 by way of an air nipple 5 and an air passage 6 and is sent further to the distal end portion (denoted by reference character A in the figure) of the barrel portion 2 by way of an air passage 6'. Additionally, an air amount adjusting device 8 for compressed air is provided at a portion which lies adjacent to the air nipple 5 in the grip portion 4. The trigger 3 can be pulled about as fulcrum $\alpha$ (a shaft portion 30 which will be described later) towards the grip portion 4, and the air valve portion 7 is opened via an air valve rod 9 which is pushed by the trigger 3, whereby the compressed air from the air passage 6 is sent to the air passage 6'.

A needle valve 10 is mounted in the air valve rod 9, and the needle valve 10 is formed as an extending portion which is concentric with the air valve rod 9. In such a situation that the trigger 3 is not pulled, the needle valve 10 is pressed against a seat portion of as paint jetting port 12P of a spray nozzle 12 which is attached to the distal end portion of the barrel portion 2 by as needle valve spring 11, whereby the spray nozzle 12 is sealed.

A joint 13 which is mounted on the barrel portion 2 is connected to the spray nozzle 12, and paint is supplied, through this joint 13. Paint that is supplied to the spray nozzle 12 is jetted from the paint jetting port 12P as a flow of mist of paint when the sealing of the spray nozzle 12 by the needle valve 10 is released.

A paint jetting amount adjusting knob 15 is provided at a rear end portion of the barrel portion 2, so that the degree of opening between the seat portion of the paint jetting, port 12P of the spray nozzle 12 and the needle valve 10 is adjusted by rotating, the paint jetting amount adjusting knob 15, whereby the jetting amount of paint can be adjusted.

In addition, an air cap 16 is disposed at a distal end portion of the spray nozzle 12 in such a way as to surround the distal portion. This air cap 16 is attached to the barrel portion 2 via a cap cover 17. An annular slit S is defined between an inner circumferential surface of the air cap 16 and an outer circumferential surface of the distal end portion of the spray nozzle 12. Compressed air from the air passage 6' jets a flow of air from the slit S along a circumference of the distal end portion of the spray nozzle 12 when the air valve portion 7 is opened.

A pair of horn portions 18 are formed on a distal end face of the air cap 16 in positions which face diametrically each other with the spray nozzle positioned between the horn portions. A side air hole 18H is formed in each of the horn portions 18 of the air cap 16 so as to connect to the air passage 6' and flows of air from these side air holes 18H can be sprayed so as to intersect a flow of mist of paint from the spray nozzle 12. By doing so, the flow of mist of paint from the spray nozzle 12 can be formed into an elliptic spray pattern by the flows of air from the side air holes 18H.

A pattern expansion adjusting knob 20 is provided at as rear end portion of the barrel portion 2, so that the degree of opening between a pattern expansion adjusting valve 21 and the seat portion is adjusted by rotating the pattern expansion adjusting knob 20, whereby the flow rate of compressed air which is sent to the side air holes 18H in the air cap 16 is adjusted. By doing so, a sectorial expansion of the spray pattern of paint jetted from the spray nozzle 12 can be adjusted.

In the spray gun 1 which is configured in the way described heretofore, the trigger 3, which is operated to jet a flow of mist of paint and flows of air, has a bifurcate construction at an end portion thereof where the trigger 3 is mounted on the barrel portion 2. In this bifurcate construction, a first locking portion 3A and a second locking portion 3B are provided in such a way as to hold the barrel portion 2 between the first and second locking portions 3A and 3B as shown in FIGS. 1A, 1B. In the trigger 3, the first locking portion 3A and the second locking portion 3B are locked at respective end portions of a shaft portion 30 which is disposed so as to extend through the barrel portion 2, and the trigger 3 is allowed to rotate relative to the barrel portion 2 about the shaft portion 30 as a fulcrum (denoted by a in FIG. 2).

FIG. 1C is an exploded view of the spray gun 1 with the trigger 3 removed therefrom as a result of removing the shaft portion 30 being removed from the spray gun 1. As is clear from FIG. 1C, the shaft portion 30 includes a first retaining shaft 331, a spring 36, and a second retaining shaft 332.

Figure 3A:
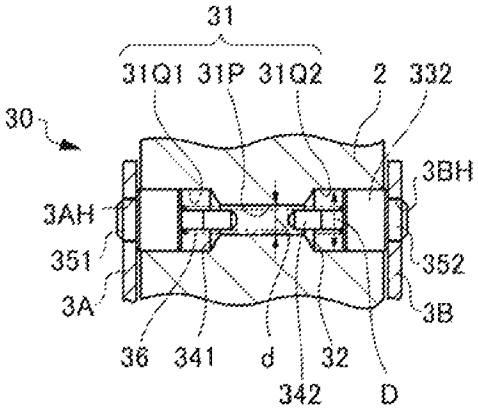
FIGS. 3A, 3B, 3C are a sectional view which shows Embodiment 1 of a mounting construction of as trigger of the spray gun of the present invention.
Figure 3B:
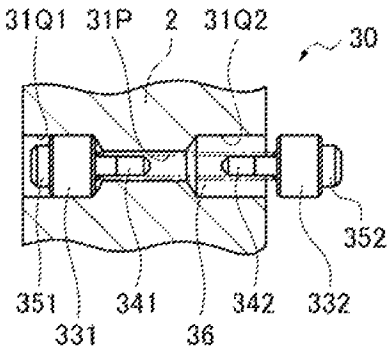
Figure 3C:
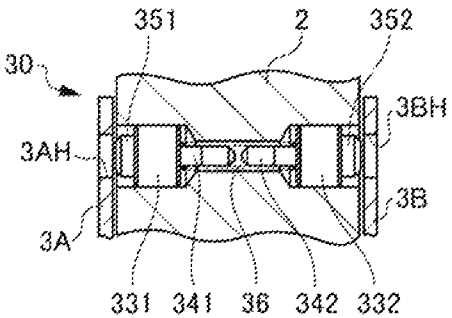

FIG. 3A is a sectional view taken along the line III-III in FIG. 1. To facilitate the understanding of a configuration shown in FIG. 3A, FIG. 3B shows a state of the shaft portion 30 which results when the pressing of the trigger 3 is released, and FIG. 3C shows a state of the shaft portion 30 which results immediately before the shaft portion 30 is brought into engagement with the trigger 3.

In FIG. 3A, a through hole 31 as a mounting hole is provided in the barrel portion 2 of the gun main body in a direction which intersects a center line of the barrel portion 2 at right angles. The through hole 31 is formed so that a diameter (d) at a central portion in the direction of the center line is small and a diameter (D) at both end portions thereof is large. A tapered step portion 32 is provided between the small diameter (d) and the large diameter (D). In the following description, a through hole at the central portion of the through hole 31 which has the small diameter is referred to as a small-diameter through hole 31P, and through holes at both the end portions of the through hole 31 which have the large diameter are referred to as a first through hole 31Q1 and a second through hole 31Q2, respectively.

As shown in FIG. 3A, the first retaining shaft 331 is disposed in the first through hole 31Q1 of the large diameter, and the second retaining shaft 332 is disposed in the second through hole 31Q2 of the large diameter.

The first retaining shaft 331 is configured to move in an axial direction within a predetermined range in the first through hole 31Q1 of the large diameter. A projecting shaft 341 is formed coaxially with the first retaining shaft 331 on an end face thereof which faces the through hole 31P of the small diameter. This projecting shaft 341 has an outside diameter which is smaller than a bore diameter of the through hole 31P of the small diameter. This projecting shaft 341 is designed to be disposed within the through hole 31P of the small diameter at least at a distal end of the projecting shaft 341 while the first retaining shaft 331 moves in the first through hole 31Q1 of the large diameter. A gap is defined between the projecting shaft 341 of the first retaining shaft 331 and the through hole 31P of the small diameter, and this gap is sized so that the spring 36, which will be described later, can be inserted therein.

A locking shaft 351 is formed coaxially with the first retaining shaft 331 on an end face of the first retaining shaft 331 which is opposite to the end face where the projecting shaft 341 is formed. This locking shaft 351 has somehow such a diameter that enables the locking shaft 351 to be inserted loosely in a hole 3AH which is formed in the first locking portion 3A of the trigger 3.

The locking shaft 351 is formed somehow in such a length that substantially prevents the projection of the locking shaft 351 from the first through hole 31Q1 of the large diameter when the first retaining shaft 331 is pushed sufficiently into an interior of the first through hole 31Q1. This is because the first locking portion 3A of the trigger 3 can be brought into engagement with the locking shaft 351 (refer to FIG. 3C).

The second retaining shaft 112 is configured to move in an axial direction within a predetermined range in the second through hole 31Q2 of the large diameter, A projecting shaft 342 is formed coaxially with the second retaining shaft 332 on an end face thereof which faces the through hole 31P of the small diameter. This projecting shaft 342 has an outside diameter which is smaller than a bore diameter of the through hole 31P of the small diameter. This projecting shaft 342 is designed to be disposed within the through hole 31P of the small diameter at least at a distal end of the projecting shaft 342 while the second retaining shaft 332 moves in the second through hole 31Q2 of the large diameter. A gap is defined between the projecting shaft 342 of the second retaining shaft 332 and the through bole 31P of the small diameter, and this gap is sized so that the spring 36, which will be described later, can be inserted therein.

A locking shaft 352 is formed coaxially with the second retaining shaft 332 on an end face of the second retaining shaft 332 which is opposite to the end face where the projecting shaft 342 is formed. This locking shaft 352 has somehow such a diameter that enables the locking shaft 352 to be inserted loosely in a hole 31Q1 which is formed in the second locking portion 332 of the trigger 3.

The locking shaft 352 is formed somehow in such a length that substantially prevents the projection of the locking, shaft 352 from the second through hole 31Q2 of the large diameter when the second retaining shaft 332 is pushed sufficiently into an interior of the second through hole 31Q2. This is because the second locking portion 3B of the trigger 3 can be brought into engagement with the locking shaft 352 (refer to FIG. 3C).

The spring 36 having an outside diameter which is almost equal to the bore diameter of the through hole 31P of the diameter is inserted into the through hole 31. This spring 36 is disposed so that the projecting shaft 341 of the first retaining shaft 331 is inserted into one end portion of the spring 36 and the projecting shaft 342 of the second retaining shaft 332 is inserted into the other end portion of the spring 36. The spring 36 is disposed between the first retaining, shaft 331 which is locked by the first locking portion 3A of the trigger 3 and the second retaining shaft 332 which is locked by the second locking portion 3B of the trigger 3, whereby the first retaining shaft 331 and the second retaining shaft 332 are biased in directions in which the first retaining shaft 331 and the second retaining shaft 332 move away from each other.

In the first retaining shaft 331, the spring 36 and the second retaining shaft 332 in the through hole 31, when the pressures on the first locking portion 3A and the second locking portion 3B of the trigger 3 are released, with the first retaining shaft 331 positioned within the first through hole 31Q1 of the large diameter, the spring 36 has such a length that causes the second retaining shaft 332 to jump out of the second through hole 31Q2 of the large diameter as shown in FIG. 3B. By adopting this configuration, when attempting to dispose the second retaining shaft 332 in the second through hole 31Q2 of the large diameter, too, the spring 36 is contracted, and the compression force applied to the spring 36 then generates a force in the spring 36 which acts in directions in which the first retaining shaft 331 and the second retaining shaft 332 move away from each other.

While the first retaining shaft 331, the spring 36 and the second retaining shaft 332 are described as being independent separate members, it is preferable that the first retaining shaft 331, the spring 36 and the second retaining shaft 332 cannot be detached from each other for example by adopting a configuration in which the spring 36 is locked on the first retaining shaft 331 at one end of the spring 36 by inserting the one end into a hole formed in the first retaining shaft 331 and is locked on the second retaining shaft 332 at the other end of the spring 36 by inserting the other end into a hole formed in the second retaining shaft 332. This is because the configuration can keep the first retaining shaft 331, the spring 36 and the second retaining shaft 332 in an integrated state to prevent them from being disengaged individually from the through hole 31 when the trigger 3 is removed from the shaft portion 30.

According to the mounting construction of the trigger 3 which is configured as shown in FIG. 1A, the first retaining shaft 331 and the second retaining shaft 332 can be pushed into the through hole 31 against the biasing force of the spring 36, whereby the trigger 3 can be disposed so that the first locking portion 3A and the second locking portion 3B are easily positioned to be opposite to the first retaining shaft 331 and the second retaining shaft 332, respectively.

Thereafter, the locking shaft 351 of the first retaining shaft 331 and the locking shall 352 of the second retaining shaft 332 are inserted into the bole 3AH in the first locking portion 3A and the hole 3BH in the second locking portion 3B of the trigger 3, respectively, by the biasing force of the spring 36, and the trigger 3 is then locked on the shaft portion 30 of the barrel portion 2 which is comprised by the first retaining shaft 331, the spring 36 and the second retaining shaft 332, whereby the trigger 3 can rotate about the shall portion 30 as a fulcrum. According to this configuration, for example, even though the distance at which the first locking portion 3A and the second locking portion 3B of the trigger 3 are spaced away from each other differs among the triggers due to the production tolerances of the trigger-related parts, since the first retaining shaft 331 is closely attached to the first locking portion 3A and the second retaining shaft 332 is closely attached to the second locking portion 3B by the biasing force of the spring 36, the configuration can provide an advantage that the drawback caused by the production tolerances can be eliminated.

The first retaining shaft 331, the spring 36 and the second retaining shaft 332 which are disposed in the through hole 31 in the barrel portion 2 can be configured so as not to be detached from each other (i.e. the first retaining shall 331, the spring 36 and the second retaining shaft 332 can be configured so as not to be detached from each other easily after they are attached to each other), whereby these trigger-related parts can be prevented from being disengaged individually from the through hole 31.

Consequently, according to the mounting construction of the trigger 3 which is configured in the way described heretofore, the trigger 3 can be mounted reliably on the gun main body, while the trigger 3 can easily be mounted on and removed from the gun main body.

Since the shaft portion 30 requires, for example, no snap ring, it is possible to obtain the spray gun which has a superior design.

Embodiment 2

Figure 4A:
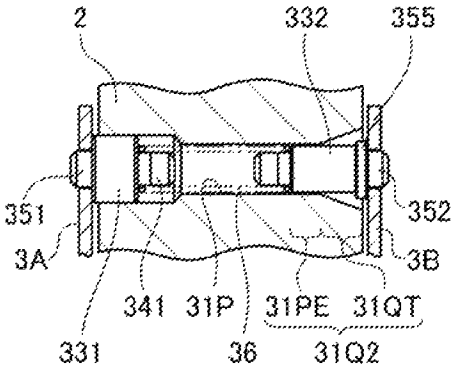
FIGS. 4A, 4B, 4C are a sectional view showing a mounting construction of a trigger of a spray gun according to Embodiment 2 of the present invention.
Figure 4B:
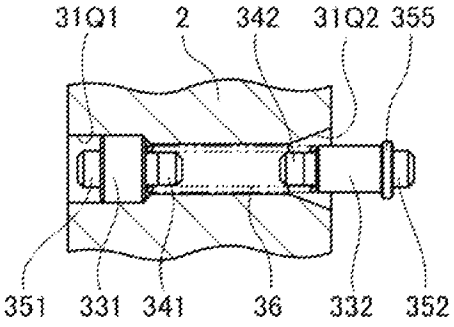
Figure 4C:
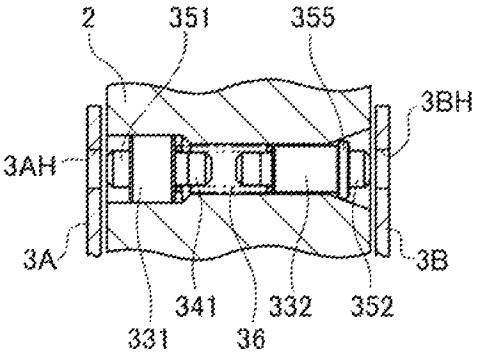

FIGS. 4A, 4B, 4C are drawings showing a mounting construction of a trigger according to Embodiment 2 of the present invention and depict the mounting construction in such a way as to correspond to FIGS. 3A, 3B, 3C, respectively.

When comparing the trigger mounting construction of Embodiment 2 shown in FIGS. 4A, 4B, 4C with that of Embodiment 1 shown in FIGS. 3A, 3B, 3C, a difference therebetween resides in the configuration of the second through hole 31Q2 of the large diameter shown in FIGS. 3A, 3B, 3C, In Embodiment 2 shown in FIGS. 4A, 4B, 4C, a second through hole 31Q2 includes an extended portion 31PE which is an extension of a through hole 31P of a small diameter, or is formed by slightly extending the through hole 31P of the small diameter in Embodiment 1 towards a surface of a barrel portion 2 and a tapered hole 31QT which expands gradually diametrically from an end portion of the extended portion 31PE towards the surface of the barrel portion 2.

In a through hole 31 which is configured as described above, the tapered hole 31QT can be cored with the use of a core in die casting, and this provides an advantage that the through hole 31 of Embodiment 2 can have a simpler configuration than that of the through hole 31 of Embodiment 1. Namely, while the configuration of the through hole of Embodiment 1 requires the gun main body to be machined front both the sides thereof, the through hole of Embodiment 2 requires a gun main body to be machined from only one side thereof where a first retaining shaft is inserted, according to FIG. 4.

A second retaining shaft 332 is formed so as to have an outside diameter which is almost equal to a bore diameter of the through hole 31P of the small diameter, and a flange portion 355 is formed at a boundary with a locking shaft 352.

The flange portion 355 has its diameter larger than that of locking shaft 352 such that the locking shaft 352 can be locked securely to the second locking portion 3B of the trigger 3.

Additionally, while the flange portion 355 is brought into abutment with a side surface of the tapered hole 31QT when the second retaining shall 332 is pushed sufficiently into the second through hole 31Q2, a diameter of the flange portion 355 is sot to such an extent that the locking shall 352 does not substantially project from the second through hole 31Q2 then (refer to FIG. 4C). This is because a second locking portion 3B of a trigger 3 is allowed to be brought into engagement with the locking shaft 352.

When adopting the trigger mounting construction described above, too, the same advantage as that obtained in Embodiment 1 can be obtained.

Embodiment 3

Figure 5A:
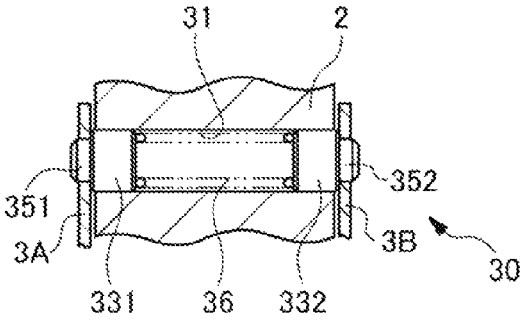
FIGS. 5A, 5B are as sectional view showing a mounting construction of as trigger of a spray gun according to Embodiment 3 of the present invention.
Figure 5B:
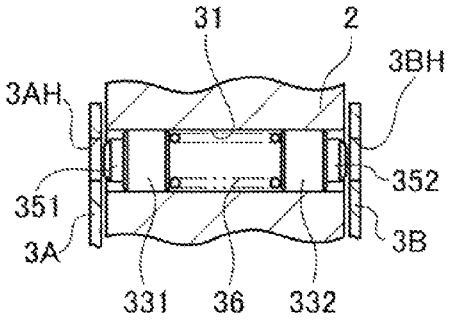

FIGS. 5A, 5B are drawings showing a mounting construction of a trigger according to Embodiment 3 of the present invention and depict the mounting construction in such a way as to correspond to FIGS. 3A, 3C, respectively.

When comparing the trigger mourning construction of Embodiment 3 shown in FIGS. 5A, 5B with that of Embodiment 1 shown in FIGS. 3A, 3C, a difference therebetween resides in a configuration in which a through hole 31 is made up of only through holes 31Q1, 31Q2 of a large diameter and the through hole 31P of the small diameter is not formed.

In the through holes 31Q1, 31Q2 of the large diameter, a first retaining shaft 331, a spring 36 and a second retaining shall 332 are disposed sequentially in that order from one end to the other end of the through hole 31 as done in Embodiment 1. The spring 36 is configured to have an outside diameter which is almost the same as a bore diameter of the through hole 31.

Additionally, while locking shafts 351, 352 are formed on the first retaining shall 331 and the second retaining shaft 332, respectively, projecting shafts (those denoted by reference numerals 341, 342 in FIG. 3) are not formed thereon. This is because a through hole of a small diameter (that denoted by reference numeral 31P in FIG. 3) is not formed in the through hole 31.

When adopting the trigger mounting construction described above, too, the same advantage as that obtained in Embodiment 1 can be obtained.

Embodiment 4

Figure 6A:
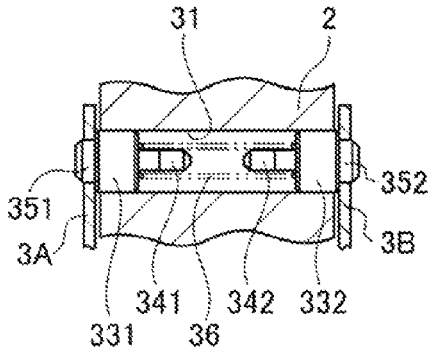
FIGS. 6A, 6B are a sectional view showing a mounting construction of a trigger of as spray gun according to Embodiment 4 of the present invention.
Figure 6B:
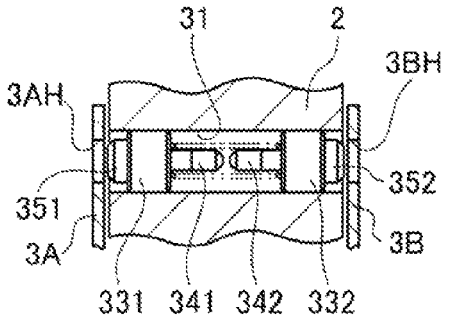

FIGS. 6A, 6B are drawings showing a mounting construction of a trigger according to Embodiment 4 of the present invention and depict the mounting construction in such a way as to correspond to FIGS. 3A, 3C, respectively.

When comparing the trigger mounting construction of Embodiment 4 shows in FIGS. 6A, 6B with that of Embodiment 1 shown in FIGS. 3A, 3C, a difference therebetween resides in a configuration in which a through hole 31 is made up of only through holes 31Q1, 31Q2 of a large diameter and the through bole 31P of the small diameter is not formed, in a similar manner in FIGS. 5A, 5B.

However, in the trigger mounting construction which is configured differently from that shown in FIGS. 5A, 5B, projecting shafts 341, 342 are formed on a first retaining shaft 331 and a second retaining shall 332, respectively. A spring 36 which is disposed between the first retaining shaft 331 and the second retaining shaft 332 is formed to have a bore diameter which is almost equal to an outside diameter of the projecting shafts 341, 342 so that the projecting, shaft 341 of the first retaining shaft 331 and the projecting shaft 342 of the second retaining shaft 332 are allowed to be inserted into the spring 36.

When adopting the trigger mounting construction described above, too, the same advantage as that obtained in Embodiment 1 can be obtained.

Embodiment 5

Figure 7A:
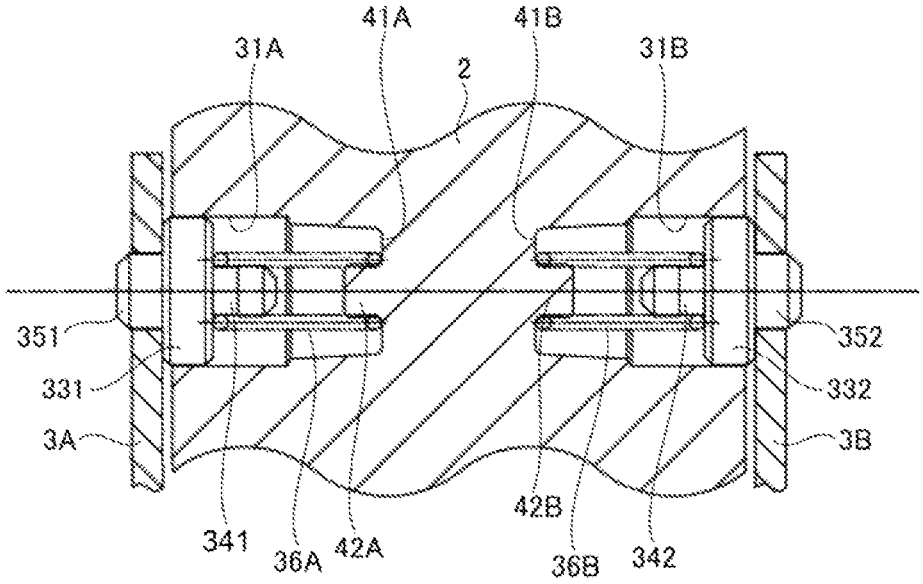
FIGS. 7A, 7B are a sectional view showing a mounting construction of a trigger of a spray gun according to Embodiment 5 of the present invention.

FIG. 7A is a drawing showing a minting construction of 3 trigger according to Embodiment 5 of the present invention and depicts the mounting construction in such a way as to correspond to FIG. 3A.

When comparing the trigger mounting construction of Embodiment 5 shown in FIG. 7 with the trigger mounting construction of Embodiment 1 shown in FIG. 3A, a difference therebetween resides firstly in a configuration in which holes in which a first retaining shaft 331 and a second retaining shaft 332 are incorporated are formed as a bottomed hole 31A and a bottomed hole 31B (mounting holes). Because of this, the through hole 31 shown in FIG. 3A is not formed in this embodiment.

Additionally, a spring 36A is disposed in the bottomed hole 31A in which first retaining shaft 331 is incorporated so as to bias the first retaining shaft 331 in a direction in which the first retaining shaft 331 moves away from a bottom portion 41A of the bottomed hole 31A. A spring 36B is disposed in the bottomed hole 31B in which the second retaining shaft 332 is incorporated so as to bias the second retaining shaft 332 in a direction in which the second retaining shaft 332 moves away from a bottom portion 41B of the bottomed hole 31B.

As this occurs, a projecting portion 42A is formed on the bottom portion 41A of the bottomed hole 31A so as to position the spring 36A, and this projecting portion 42A is inserted into the spring 36A. Similarly, a projecting portion 42B is formed on the bottom portion 41B of the bottomed hole 31B so as to position the spring 36B, and this projecting portion 42B is inserted into the spring 36B.

Figure 7B:
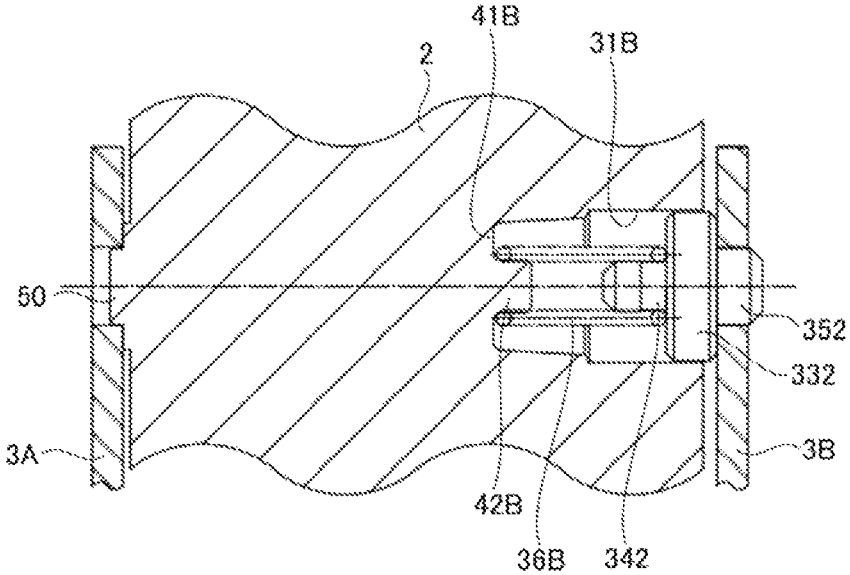
Figure 8A:
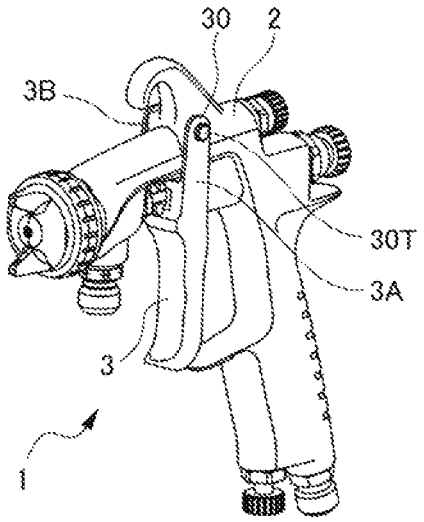
FIGS. 8A, 8B, 8C are a schematic view which shows an external appearance of as conventional spray gun.
Figure 8B:
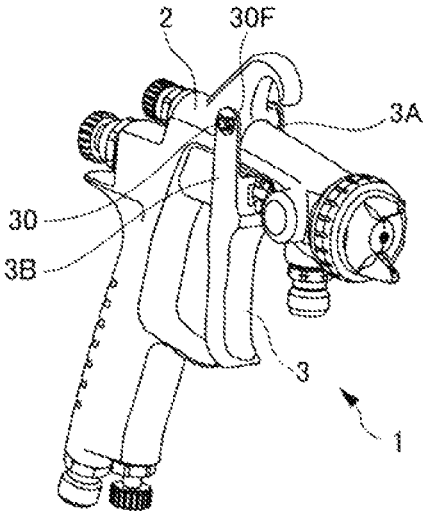
Figure 8C:
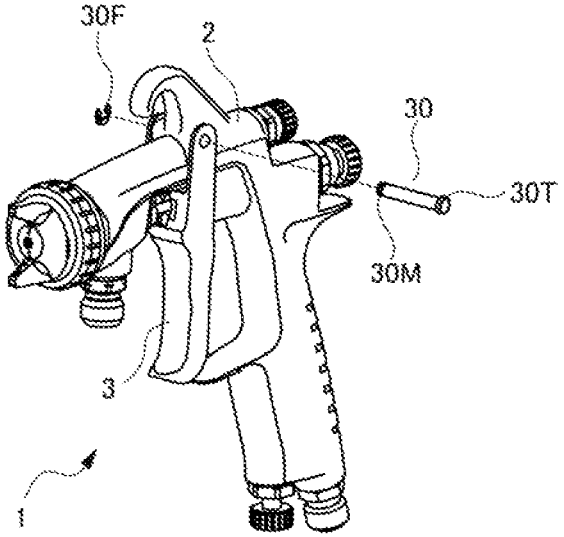

FIG. 7B shows a modified example made to the configuration shown in FIG. 7A. In this modified example, for example, the first retaining shaft 331 shown in FIG. 7A is not configured in the way described above but is configured as a projecting member 50 which is formed integrally with a barrel portion 2. When this configuration is adopted, the bottomed hole 31A, the first retaining shaft 331 and the spring 36A are not used in the barrel portion 2, which can provide an advantage that the resulting configuration becomes simple. Meanwhile, alternative configuration that the bottomed hole 31A, the first retaining shaft 331 and the spring 36A are used in the barrel portion 2, while the second retaining shaft 332 can be configured as a projecting member 50 formed integrally with a barrel portion 2.

When adopting the trigger mounting construction described above, too, the same advantage as that obtained in Embodiment 1 can be obtained.

It should be noted that the first retaining shaft 331 or the second retaining shaft 332 can be configured as a projecting member 50 formed integrally with a barrel portion 2 in any one of Embodiments 1-4.

(1) According to one aspect of the present invention, there is provided as spray gun including a gun main body, and a trigger which has a first locking portion which is locked at one end of a shaft portion disposed to extend through the gun main body and a second locking portion which is locked at the other end of the shaft portion, and which trigger is operated to rotate about the shall portion. The shall portion is incorporated in a through hole which penetrates the gun main body and includes a first retaining shaft which is locked rotatably on the first locking portion of the trigger, a second retaining shaft which is locked rotatably on the second locking portion of the trigger, and an elastic member which is disposed between the first retaining shaft and the second retaining shaft to bias the first retaining, shaft and the second retaining shaft in directions in which the first retaining shaft and the second retaining shaft move away from each other.

(2) According to one aspect of the present invention, there is provided the spray gun according to aspect (1), wherein the first retaining shaft is locked on the first locking portion of the trigger by inserting a projection formed on the first retaining shaft in a hole formed in the first locking portion and wherein the second retaining shaft is locked on the second locking portion of the trigger by inserting a projection formed on the second retaining shaft in a hole formed in the second rocking portion.

(3) According to one aspect of the present invention, there is provided the spray gun according to aspect (1) or (2), wherein the elastic element is a spring.

(4) According to one aspect of the present invention, there is provided the spray gun according to aspect (3), wherein the spring is locked on the first retaining shaft and the second retaining shaft.

(5) According to one aspect of the present invention, there is provided the spray gun according to any one of aspects (1)-(4), wherein the through hole is such that a diameter at both longitudinal end portions is larger than a diameter at a central portion of the through hole.

(6) According to one aspect of the present invention, there is provided the spray gun according to any one of aspects (1)-(4), wherein the through hole has the same diameter along a longitudinal direction of the through hole.

(7) According to one aspect of the present invention, there is provided the spray gun according to any one of aspects (1)-(4), wherein the through hole is formed so that a diameter at an end portion where the first retaining shaft is disposed differs from a diameter at the other end portion where the second retaining shaft is disposed, and wherein the first retaining shaft and the second retaining shaft have diameters which match the corresponding diameters of the through hole.

(8) According to one aspect, there is provided a spray gun including a gun main body, and a trigger which has a first locking portion which is locked at one end of a shaft portion formed on the gun main body and a second locking portion which is locked at the other end of the shaft portion and which trigger is operated to rotate about the shaft portion. The shaft portion on which at least either of the first locking portion and the second locking portion of the trigger is locked includes a retaining shaft which is disposed in a bottomed hole formed in the gun main body, and an elastic member which is disposed between a bottom portion of the bottomed hole and the retaining shaft to bias the retaining shaft in a direction in which the retaining shaft moves away from the bottom portion.

(9) According to one aspect, there is provided the spray gun according to the aspect (8), wherein the shaft portion includes a projecting member which is formed on the gun main body, and the first locking portion or the second locking portion is locked on the projecting member.

(10) According to one aspect, there is provided a spray gun comprising: a gun main body: and a trigger having a first locking portion and a second locking portion, the first locking portion locked at one end of a shaft portion provided on the gun main body, the second locking portion locked at the other end of the shaft portion, the trigger operable to rotate about the shaft portion, wherein the shaft portion comprises: a first retaining shaft disposed in a mounting hole formed in the gun main body and locked rotatably on the first locking portion of the trigger; and an elastic member disposed in the mounting hole to bias the first retaining shaft in a direction in which the first retaining shaft exits from the mounting hole.

According to the configurations that have been described above, it is possible to obtain the spray gun in which the trigger can be reliably mounted on the gun main body while the trigger can be mounted on and removed from the gun main body extremely easily, which can absorb production tolerances of the spray gun main body and the trigger, whereby the trigger-related parts can be made common use of even for different spray guns whose gun main bodies have slightly different widths, and which has the superior design.

Thus, while the invention has been described by the use of the embodiments, needless to say, the technical scope of the invention is not limited to the scopes of the embodiments described heretofore. It is obvious to those skilled in the art to which the invention pertains that various modifications or improvements can be made to the embodiments. Additionally, it is also obvious from claims to be made separately that those modified or improved embodiments can also be included in the technical scope of the invention.

The present application claims priority to Japanese Patent Application No. 2013-081664 filed on Apr. 9, 2013. The entire disclosure of Japanese Patent Application No. 2013-081664 filed on Apr. 9, 2013 including specification, claims, drawings and summary is incorporated herein by reference in its entirety.

The entire disclosure of Japanese Laid-Open publication No. 1109-253538 including specification, claims, drawings and summary is incorporated herein, by reference in its entirety.

DESCRIPTION OF REFERENCE NUMERALS

1 spray gun; 2 barrel portion; 3 trigger; 3A first locking portion; 3B second locking portion; 4 grip portion; 5 air nipple; 6, 6' air passage; 7 air valve portion; 8 air amount adjusting device; 9 air valve rod; 10 needle valve; 11 needle valve spring; 12 spray nozzle; 12P paint jetting port; 13 joint; 15 paint jetting amount adjusting knob; 16 air cap; 17 cap cover; 18 horn portion; 18H side air hole; 20 pattern expansion adjusting knob; 21 pattern expansion adjusting valve; 30 shaft portion; 31 through hole; 31A, 31B bottomed hole; 31P through hole of small diameter; 31Q1 first through hole of large diameter; 31Q2 second through hole of large diameter; 32 step portion; 331 first retaining shaft; 332 second retaining shaft; 341, 342 projecting shaft; 351, 352 locking shaft; 355 flange portion; 36, 36A, 36B spring; 50 projecting member.

What is claimed:

1. A spray gun comprising:

a gun main body;

a through hole penetrating the gun main body;

a shaft assembly in the through hole, the shaft assembly including:

a first retaining shaft, a second retaining shaft, and a single elastic member between the first retaining shaft and the second retaining shaft biasing both the first retaining shaft and the second retaining shaft in a direction in which the first retaining shaft and the second retaining shaft move away from each other and in which the first retaining shaft and the second retaining shaft exit from the through hole;

a trigger having a first locking portion rotatably locked onto the first retaining shaft, and a second locking portion rotatably locked on the second retaining shaft, wherein the trigger is operable to rotate about the first and second retaining shafts.

2. The spray gun according to claim 1, wherein the first locking portion of the trigger includes a hole, and the first retaining shaft includes a projection, and the first retaining shaft is locked on the first locking portion of the trigger by insertion of the projection formed on the first retaining shaft in the hole formed in the first locking portion, and the second locking portion of the trigger includes a hole, and the second retaining shaft includes a projection, and the second retaining shaft is locked on the second locking portion of the trigger by insertion of the projection formed on the second retaining shaft in the hole formed in the second locking portion.

3. The spray gun according to claim 1, wherein the elastic element comprises a spring.

4. The spray gun according to claim 3, wherein the spring is locked on the first retaining shaft and the second retaining shaft.

5. The spray gun according to claim 1, wherein the through hole is such that a diameter at both longitudinal end portions is larger than a diameter at a central portion of the through hole.

6. The spray gun according to claim 1, wherein the through hole has the same diameter along a longitudinal direction of the through hole.

7. The spray gun according to claim 1, wherein the through hole is formed such that a diameter at an end portion where the first retaining shaft is disposed differs from a diameter at the other end portion where the second retaining shaft is disposed, and wherein the first retaining shaft and the second retaining shaft have diameters which match the corresponding diameters of the through hole.

8. A spray gun comprising:

a gun main body;

a through hole penetrating the gun main body;

a shaft assembly in the through hole, the shaft assembly including:

a first retaining shaft, a second retaining shaft, and an elastic member between the first retaining shaft and the second retaining shaft biasing both the first retaining shaft and the second retaining shaft in a direction in which the first retaining shaft and the second retaining shaft move away from each other and in which the first retaining shaft and the second retaining shaft exit from the through hole;

a trigger having a first locking portion rotatably locked onto the first retaining shaft, and a second locking portion rotatably locked on the second retaining shaft, wherein the trigger is operable to rotate about the first and second retaining shafts, wherein the through hole is such that a diameter at both longitudinal end portions is larger than a diameter at a central portion of the through hole.

9. A spray gun comprising:

a gun main body;

a through hole penetrating the gun main body;

a shaft assembly in the through hole, the shaft assembly including:

a first retaining shaft, a second retaining shaft, and an elastic member between the first retaining shaft and the second retaining shaft biasing both the first retaining shaft and the second retaining shaft in a direction in which the first retaining shaft and the second retaining shaft move away from each other and in which the first retaining shaft and the second retaining shaft exit from the through hole;

a trigger having a first locking portion rotatably locked onto the first retaining shaft, and a second locking portion rotatably locked on the second retaining shaft, wherein the trigger is operable to rotate about the first and second retaining shafts, wherein the through hole is formed such that a diameter at an end portion where the first retaining shaft is disposed differs from a diameter at the other end portion where the second retaining shaft is disposed, and wherein the first retaining shaft and the second retaining shaft have diameters which match the corresponding diameters of the through hole.

10. A spray gun comprising:

a gun main body;

a mounting hole in the gun main body, the mounting hole having a bottom;

a projection member formed integrally on the gun main body;

a shaft assembly in the mounting hole, the shaft assembly including:

a first retaining shaft, and an elastic member between the first retaining shaft and the bottom of the mounting hole biasing the first retaining shaft in a direction in which the first retaining shaft moves away from the bottom of the mounting hole;

a trigger having a first locking portion rotatably locked onto the first retaining shaft, and a second locking portion rotatably locked on the projection member, wherein the trigger is operable to rotate about the first retaining shaft and the projection member.

* * * * *